US008268525B2

(12) United States Patent
Joo et al.

(10) Patent No.: US 8,268,525 B2
(45) Date of Patent: Sep. 18, 2012

(54) TONER USABLE WITH ELECTROPHOTOGRAPHY AND METHOD OF PREPARING THE SAME

(75) Inventors: Hae-ree Joo, Anyang-si (KR); Sung-jun Park, Hwaseong-si (KR); Jae-hwan Kim, Seoul (KR); Min-ho Yang, Suwon-si (KR); Kyeong Pang, Suwon-si (KR)

(73) Assignee: SAMSUNG Electronics Co., Ltd., Suwon-si (KR)

( * ) Notice: Subject to any disclaimer, the term of this patent is extended or adjusted under 35 U.S.C. 154(b) by 211 days.

(21) Appl. No.: 12/690,275

(22) Filed: Jan. 20, 2010

(65) Prior Publication Data

US 2010/0196814 A1 Aug. 5, 2010

(30) Foreign Application Priority Data

Feb. 3, 2009 (KR) ..... 10-2009-0008537

(51) Int. Cl.
*G03G 9/083* (2006.01)

(52) U.S. Cl. ..... 430/108.24; 430/108.7; 430/108.8; 430/110.1; 430/110.2; 430/110.3

(58) Field of Classification Search ..... 430/108.24, 430/108.7, 108.8, 110.1, 110.2, 110.3
See application file for complete search history.

(56) References Cited

U.S. PATENT DOCUMENTS

| | | | | |
|---|---|---|---|---|
| 2009/0324296 | A1* | 12/2009 | Joo et al. | 399/262 |
| 2010/0151372 | A1* | 6/2010 | Kim et al. | 430/105 |
| 2010/0151376 | A1* | 6/2010 | Kim et al. | 430/108.7 |
| 2010/0178604 | A1* | 7/2010 | Lee et al. | 430/108.4 |
| 2010/0178605 | A1* | 7/2010 | Koo et al. | 430/108.4 |
| 2010/0196813 | A1* | 8/2010 | Shin et al. | 430/108.4 |

* cited by examiner

*Primary Examiner* — Peter Vajda
(74) *Attorney, Agent, or Firm* — Stanzione & Kim, LLP

(57) ABSTRACT

A toner usable with electrophotography includes an iron (Fe) content in the toner is in a range of about $1.0\times10^2$ ppm to about $1.0\times10^4$ ppm and a circle equivalent diameter of a sectional area of an Fe agglomerating agent is in a range of about 1.0 nm to about $2.0\times10^2$ nm.

15 Claims, 2 Drawing Sheets

TONER USABLE WITH ELECTROPHOTOGRAPHY AND METHOD OF PREPARING THE SAME

CROSS-REFERENCE TO RELATED APPLICATIONS

This application claims priority under 35 U.S.C. §119(a) from Korean Patent Application No. 10-2009-0008537, filed on Feb. 3, 2009, in the Korean Intellectual Property Office, the disclosure of which is incorporated herein by reference in its entirety.

BACKGROUND

1. Field of the Invention

The present general inventive concept relates to a toner usable with electrophotography and a method of preparing the same.

2. Description of the Related Art

In electrophotographic processes or electrostatic recording processes, a developer used to shape an electrostatic image or an electrostatic latent image can be classified as a two- component developer formed of toner and carrier particles, or a one-component developer formed of only toner. The one-component developer can be classified as a magnetic one-component developer or a nonmagnetic one-component developer. Fluidizing agents, such as colloidal silica, are often added to the nonmagnetic one-component developer to increase a fluidity of the toner. Typically, coloring particles obtained by dispersing a pigment, such as carbon black, or other additives in a binding resin are used as the toner.

Methods of preparing toner include pulverization and polymerization. In the pulverization method, the toner is obtained by melting and mixing synthetic resins with pigments and, if required, other additives. After the melting and mixing, the toner is obtained by pulverizing the mixture and sorting particles until particles of a desired size are obtained. In the polymerization method, a polymerizable monomer composition is manufactured by uniformly dissolving or dispersing various additives, such as a pigment, a polymerization initiator and, if required, a cross-linking agent and an antistatic agent in a polymerizable monomer. Then, the polymerizable monomer composition is dispersed in an aqueous dispersive medium, which includes a dispersion stabilizer by using an agitator to shape minute liquid droplet particles. Subsequently, a temperature of the aqueous dispersive medium is increased and suspension polymerization is performed to obtain polymerized toner having coloring polymer particles of a desired size.

In an image forming apparatus, such as an electrophotographic apparatus or an electrostatic recording apparatus, an image is formed by exposing an image on a uniformly charged photoreceptor to form an electrostatic latent image thereon, attaching toner to the electrostatic latent image to form a toner image, transferring the toner image onto a transfer medium, such as transfer paper, and then fixing the toner image onto the transfer medium by using any of a variety of methods, including heating, pressurizing, and solvent steaming. In some fixing processes, the transfer medium having the toner image disposed thereon passes through fixing rollers and pressing rollers and the toner image is fused to the transfer medium by heating and pressing.

Images formed by an image forming apparatus, such as an electrophotocopier, should satisfy requirements of high precision and accuracy. Conventionally, toner used in an image forming apparatus is typically obtained by the pulverization method. In the pulverization method, color particles having a large range of sizes are formed. Therefore, to obtain satisfactory developing properties, there is a need to sort the color particles obtained through the pulverization method according to size so as to reduce a particle size distribution. However, it is difficult to precisely control the particle size and the particle size distribution by using a conventional mixing/pulverizing process in the manufacture of toner that is suitable for an electrophotographic process or an electrostatic recording process. Also, when preparing a fine- particle-sized toner, the toner preparation yield is adversely affected by the sorting process. In addition, there are limits to a change/adjustment of a toner design to obtain desirable charging and fixing properties. Accordingly, polymerized toner, wherein size of the toner particles are easy to control and which do not need to undergo a complex manufacturing process, such as sorting, have been highlighted recently.

When toner is prepared through the polymerization method, polymerized toner having a desired particle size and particle size distribution may be obtained without pulverizing or sorting. However, even with polymerized toner, there are still demands for excellent print performance and high image quality when printing, and for physical properties of the toner, including a fixing property and a durability. Therefore, to fulfill these demands, there is still a need to develop a toner having various internal additives adequately dispersed therein, distributed through the use of an agglomerating agent that is high in a cohesive force in the an agglomeration operation of preparing the polymerized toner, is resistant to an external environment, and is safe to humans.

SUMMARY OF THE INVENTION

The present general inventive concept provides a toner, which is excellent in fluidity and durability due to toner particles distributed in appropriate contents, capable of maintaining a long-term storage stability, achieving improved glossiness to provide high image quality, and providing an increased fixing area.

Additional features and/or utilities of the present general inventive concept will be set forth in part in the description which follows and, in part, will be obvious from the description, or may be learned by practice of the general inventive concept.

The present general inventive concept may be achieved by providing a toner usable with electrophotography which includes a latex, a colorant, and a release agent, wherein an iron (Fe) content in the toner is in a range of about $1.0\times10^2$ ppm to about $1.0\times10^4$ ppm and a circle equivalent diameter of a sectional area of an Fe agglomerating agent is in a range of about 1.0 nm to about $2.0\times10^2$ nm.

The toner may include a core layer including a first latex, a colorant, and a release agent, and a shell layer including a second latex coated on the core layer.

The toner may include sulfur (S), Fe and silicon (Si), and contents thereof are indicated by [S], [Fe], and [Si], the toner may include a [S]/[Fe] ratio in a range of about $5.0\times10^{-4}$ to about $5.0\times10^{-2}$, and a [Si]/[Fe] ratio in a range of about $5.0\times10^{-4}$ to about $5.0\times10^{-2}$.

The release agent may include a mixture of paraffin-based wax and ester-based wax or paraffin-based wax containing an ester group.

Wherein if the releasing agent includes a mixture including the paraffin-based wax and the ester-based wax, an amount of the ester-based wax may be in a range of about 5% to 39% by weight based on a total amount of the release agent.

A volume average particle diameter of the toner may be in a range of about 3 μm to about 8 μm.

An average circularity of the toner may be in a range of about 0.940 to about 0.990.

A geometric standard deviation by volume (GSDv) and a geometric standard deviation by number (GSDp) values of the toner may be about 1.30 or less.

The present general inventive concept may also be achieved by providing a method to prepare a toner usable with electrophotography which includes preparing a mixture solution by mixing first latex particles with a colorant dispersion and a release agent dispersion, preparing a first agglomerated toner by adding an agglomerating agent to the first latex particles, and preparing a second agglomerated toner by coating second latex particles on the first agglomerated toner prepared by polymerizing at least one polymerizable monomer, wherein an iron (Fe) content in the toner is in a range of about $1.0\times10^2$ ppm to about $1.0\times10^4$ ppm and a circle equivalent diameter of a sectional area of an Fe agglomerating agent is in a range of about 1.02 nm to about $2.0\times10^2$ nm.

The first latex particles may include polyester used alone, a polymer obtained by polymerizing one or more polymerizable monomers, or a mixture thereof.

The method may further include coating a third latex prepared by polymerizing one or more polymerizable monomers to the second agglomerated toner.

The polymerizable monomer may include at least one selected from the group consisting of styrene-based monomers; acrylic acid or methacrylic acid; derivatives of (metha) acrylates; ethylenically unsaturated mono-olefins; halogenized vinyls; vinyl esters; vinyl ethers; vinyl ketones; and nitrogen-containing vinyl compounds.

The release agent dispersion may include a mixture of a paraffin-based wax and an ester-based wax or a paraffin-based wax containing ester groups.

The agglomerating agent may further include a metal salt containing Si and Fe.

The agglomerating agent may further include polysilicate iron.

The present general inventive concept may also be achieved by providing a toner supplying unit comprising a toner tank to store toner, a supplying part to project inside the toner tank to discharge the toner, and a toner agitating member rotatably disposed inside the toner tank to agitate the toner in an inner space of the toner tank including a location on a top surface of the supplying part, wherein the toner comprises the toner of claim 1.

The present general inventive concept may also be achieved by providing an imaging apparatus comprising an image carrier, an image forming unit to form an electrostatic latent image on a surface of the image carrier, a unit to receive a toner, a toner supplying unit to supply the toner onto the surface of the image carrier to develop the electrostatic latent image into a toner image, and a toner transferring unit to transfer the toner image to a transfer medium, wherein the toner comprises the toner of claim 1.

The present general inventive concept may also be achieved by providing a developer to develop an electrostatic latent image which includes a toner having a first latex, a first colorant, and a first release agent, wherein an iron (Fe) content in the toner is in a range of about $1.0\times10^2$ ppm to about $1.0\times10^4$ ppm.

The developer may further include an Fe agglomerating agent having a circle equivalent cross-sectional diameter in a range of about 1.0 nm to about $2.0\times10^2$ nm.

The developer may further include a first layer including the first latex, the first colorant, and the first release agent, and a second layer including a second latex coated on the first layer.

BRIEF DESCRIPTION OF THE DRAWINGS

The above and/or other features and utilities of the present general inventive concept will become more apparent by describing in detail exemplary embodiments thereof with reference to the attached drawings in which.

DETAILED DESCRIPTION OF THE EMBODIMENTS

Figure 1:
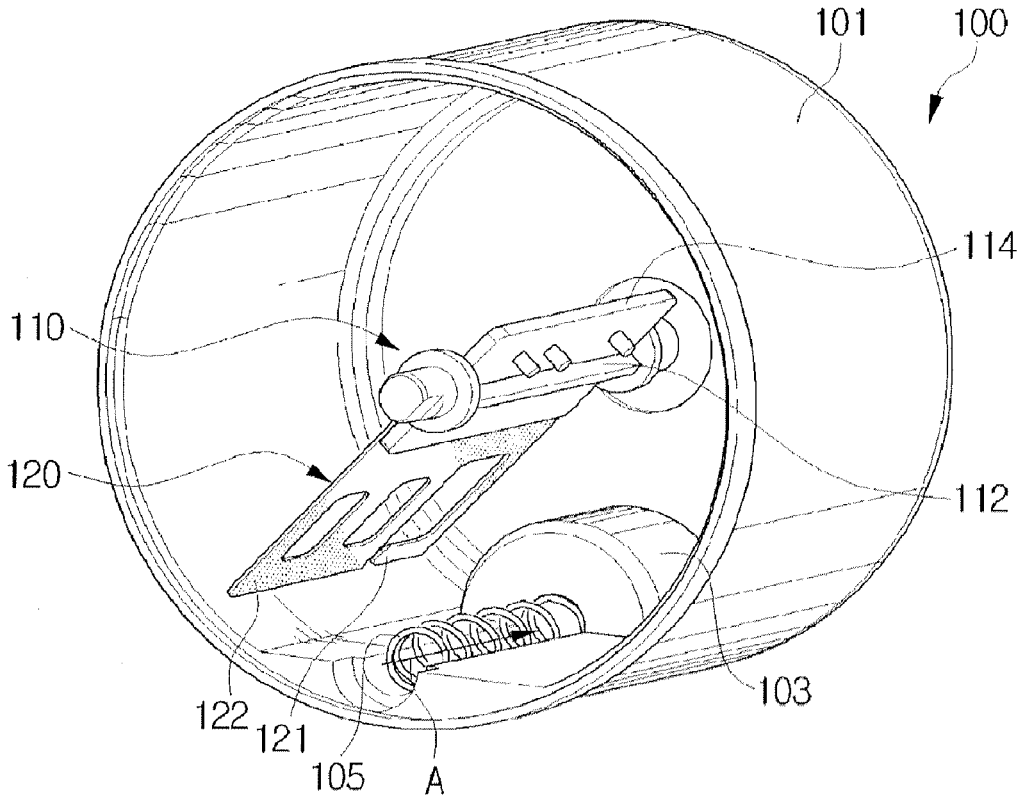
FIG. 1 is a perspective view of a toner supplying unit according to an exemplary embodiment of the present general inventive concept.

Reference will now be made in detail to the exemplary embodiments of the present general inventive concept, examples of which are illustrated in the accompanying drawings, wherein like reference numerals refer to the like elements throughout. The exemplary embodiments are described below in order to explain the present general inventive concept by referring to the figures.

Exemplary embodiments of the present general inventive concept provide a toner usable with electrophotography and a method of developing an electrostatic latent image. The content of iron (Fe) detected in the toner may be in a range of about $1.0\times10^2$ ppm to about $1.0\times10^4$ ppm and a circle equivalent diameter of a sectional area of an Fe agglomerating agent may be in a range of about 1.0 to about $2.0\times10^2$ nm, as analyzed by using transmission electron microscopy (TEM).

In exemplary embodiments, the toner according to an exemplary embodiment of the present general inventive concept includes the Fe agglomerating agent which is high in a cohesive force in the agglomeration operation of preparing a polymerized toner, is resistant to an external environment, and is safe to humans. Since content and distribution of the Fe agglomerating agent in the toner affect a fluidity, a charging property, a durability, and a long-term stability of the toner, it may be necessary to adequately control the content and distribution of the Fe agglomerating agent.

The Fe content detected in the toner may be, for example, in a range of about $1.0\times10^2$ ppm to about $1.0\times10^4$ ppm. If the Fe content is less than about $1.0\times10^2$ ppm, the Fe agglomerating agent may not serve as an agglomerating agent in the agglomeration operation of preparing the toner, so that the toner particles may not be properly formed. If the Fe content is larger than $1.0\times10^4$ ppm, excess metal ions are likely to affect as impurities of the toner, thereby deteriorating charging properties of the toner.

As stated above, the circle equivalent diameter of a sectional area of each of the Fe agglomerating agents is in the range of about 1.0 nm to about $2.0\times10^2$ nm. A sectional area of the Fe agglomerating agent is analyzed using the TEM. If the circle equivalent diameter is less than 1.0 nm, the agglomeration efficiency may be reduced. However, if the circle equivalent diameter is larger than $2.0\times10^2$ nm, the Fe agglomerating agents may not be properly dispersed in the toner, the dispersion of the internal additives of the toner may not be performed properly, either, which thereby deteriorates the durability of the toner and results in image defects.

In exemplary embodiments, the toner may have a single-layered structure including a latex, a colorant, and a release agent. In alternative exemplary embodiments, the toner having a single-layered structure may have an additional latex coated thereon. In the present exemplary embodiment, the single-layered structure in the interior of the toner may be referred to as a core layer, and the additional latex may be referred to as a shell layer. That is, the core layer of the toner may include a first latex, a colorant, and a release agent, and the shell layer may include a second latex coated on the core layer.

In alternative exemplary embodiments of the present general inventive concept, second and third shell layers may further be formed by adding additional latexes to the toner having the core layer and the shell layer.

Therefore, in a case where the toner according to an exemplary embodiment of the present general inventive concept includes a core layer including a first latex, a colorant, and a release agent, and a shell layer including a second latex coated on the core layer, the content of an Fe agglomerating agent detected in the toner may be in a range of about $1.0\times10^2$ ppm to about $1.0\times10^4$ ppm. If the Fe content is less than $1.0\times10^2$ ppm, the Fe content may not serve as an agglomerating agent in the agglomeration operation to prepare the toner, so that toner particles may not be properly formed. If the Fe content is larger than $1.0\times10^4$ ppm, excess metal ions are likely to affect the toner as impurities, thereby deteriorating charging properties of the toner.

In exemplary embodiments, the toner includes sulfur (S), Fe and silicon (Si), and when the contents thereof, as measured by fluorescent X-ray analysis, are indicated by [S], [Fe] and [Si], the toner has a [S]/[Fe] ratio in a range of about $5.0\times10^{-4}$ to about $5.0\times10^{-2}$, and a [Si]/[Fe] ratio in a range of about $5.0\times10^{-4}$ to about $5.0\times10^{-2}$.

In order to adjust a molecular weight distribution of latex in preparation for use in the toner, a chain transfer agent, e.g., a S-containing compound may be used. Here, the [S] is a numerical value corresponding to an amount of S in the chain transfer agent. Accordingly, when the [S] value is high, the molecular weight of latex may be reduced and new chains may be initiated by using the chain transfer agent. On the other hand, when the [S] value is low, chains continuously grow, so that the molecular weight of the latex may be increased.

The [Fe] is a numerical value corresponding to an amount of Fe in the agglomerating agent used to agglomerate the latex, the colorant, and the release agent in the process of preparing the toner. Thus, the agglomerating property, particle size distribution and particle sizes of the agglomerated toner, that is, a precursor of preparing the target toner, may be affected by the [Fe].

The [Si] is a numerical value corresponding to an amount of externally added silica particles in the agglomerating agent may be used to obtain rheological properties of polysilica and the toner within the agglomerating agent. The agglomerating property, particle size distribution and particle sizes, and the rheological properties of the toner may be affected by the [Si].

In exemplary embodiments, a [S]/[Fe] ratio may be in ranges of about $5.0\times10^{-4}$ to about $5.0\times10^{-2}$, about $8.0\times10^{-4}$ to about $3.0\times10^{-2}$, and about $1.0\times10^{-3}$ to about $1.0\times10^{-2}$.

When the [S]/[Fe] ratio is less than 5.0×10-4, the [S] value is too low. Thus, the molecular weight of toner may be reduced. In addition, the excess [Fe] may adversely affect the agglomerating property or cause problems such as charge reduction. On the other hand, when the [S]/[Fe] ratio is larger than $5.0\times10^{-2}$, the [S] is too high, the molecular weight of toner is considerably reduced. Otherwise, a shortage of [S] may adversely affect the agglomerating property, and the particle size distribution or particle size of toner may be significantly affected.

A [Si]/[Fe] ratio may be in ranges of about $5.0\times10^{-4}$ to about $5.0\times10^{-2}$, about $8.0\times10^{-4}$ to about $3.0\times10^{-2}$, and about $1.0\times10^{-3}$ to about $1.0\times10^{-2}$.

When the [Si]/[Fe] ratio is less than $5.0\times10^{-4}$, an amount of silica as an externally added additive is too small to obtain sufficient rheological properties of toner. On the other hand, when the [Si]/[Fe] ratio is larger than $5.0\times10^{-2}$, the [Si] value is too high. Thus, an inside of a printer may become contaminated.

Alternative exemplary embodiments of the present general inventive concept provide a method to prepare a toner usable with electrophotography, which includes preparing a mixture solution by mixing first latex particles with a colorant dispersion and a release agent dispersion, and preparing a second agglomerated toner by coating second latex particles on a first agglomerated toner prepared by polymerizing at least one polymerizable monomer, wherein an [Fe] detected in the toner is in a range of about $1.0\times10^2$ ppm to about $1.0\times10^4$ ppm and a circle equivalent diameter of a sectional area of an Fe agglomerating agent is in a range of about $1.0\times10^2$ to $2.0\times10^2$ nm, as analyzed by using Transmission electron microscopy (TEM).

Exemplary embodiments of the agglomerating agent include, but are not limited to, NaCl, MgCl2, MgCl2.8H20, [Al2(OH)nCl6-n]m(Al2(SO4)3.18H2O, PAC (polyaluminum chloride), polyaluminum sulfate (PAS), polyaluminum hydroxidechloride sulfate silicate (PASS), ferric sulfate, ferrous sulfate, ferrous chloride, calcium hydroxide, potassium carbonate, and a metal salt including Si and Fe.

An amount of the agglomerating agent may be from about 0.1 to about 6 parts, for example, from about 0.5 to about 5 parts, specifically from about 1 to about 4 parts by weight based on 100 parts by weight of the first latex particles. When the amount of the agglomerating agent is less than 0.1 parts by weight based on 100 parts by weight of the first latex particles, the agglomeration efficiency may be deteriorated. On the other hand, when the amount of the agglomerating agent is larger than 6 parts by weight based on 100 parts by weight of the first latex particles, problems such as a charge reduction or deterioration in the particle size distribution may occur.

In exemplary embodiments, the metal salt containing Si and Fe may include polysilicate iron. Specifically, examples of commercially available products include PSI-025, PSI-050, PSI-085, PSI-100, PSI-200, and PSI-300, which are manufactured by Suido Kiko Co., Physical properties and compositions of PSI-025, PSI-050, PSI-085, PSI-100, PSI-200, and PSI-300 are listed below in Table 1.

TABLE 1

| Type | | PSI-025 | PSI-050 | PSI-085 | PSI-100 | PSI-200 | PSI-300 |
|---|---|---|---|---|---|---|---|
| Silicon/Fe molar ratio (Si/Fe) | | 0.25 | 0.5 | 0.85 | 1 | 2 | 3 |
| Main component concentration | Fe (wt %) | 5.0 | 3.5 | 2.5 | 2.0 | 1.0 | 0.7 |
| | $SiO_2$ (wt %) | 1.4 | 1.9 | 2.0 | | 2.2 | |

TABLE 1-continued

| Type | PSI-025 | PSI-050 | PSI-085 | PSI-100 | PSI-200 | PSI-300 |
|---|---|---|---|---|---|---|
| pH (1 w/v %) | | | 2-3 | | | |
| Specific gravity (20° C.) | 1.14 | 1.13 | 1.09 | 1.08 | 1.06 | 1.04 |
| Viscosity (mPa · S) | | | 2.0 or more | | | |
| Average molecular weight (Dalton) | | | 500,000 | | | |
| Appearance | | | Yellowish transparent liquid | | | |

When the metal salt containing Si and Fe is used as an agglomerating agent in the method to prepare the toner, the agglomerating effect is increased, so that the toner may be made into small particles and a particle size distribution may be controlled.

An average particle size of the toner according to the present general inventive concept may be in ranges of about 3 μm to about 8 μm, about 4 μm to about 7.5 μm, and about 4.5 μm to about 7 μm, and an average circularity of the toner may be in ranges of about 0.940 to about 0.990, about 0.945 to about 0.985, and about 0.950 to about 0.980.

In general, when the toner has relatively small particle sizes, it can advantageously achieve high resolution and high image quality, which are, however, disadvantageous features in view of transfer speed and cleaning capacity. Accordingly, it is important to gain a toner having appropriate particle sizes. A volume average particle diameter of the toner may be measured by using an electrical impedance analysis. However, other forms of measuring a volume average particle diameter may be used which perform the intended purpose of the general inventive concept as described herein.

When the volume average particle diameter of the toner is less than 3 μm, problems, such as contamination of a photoreceptor, a reduced yield of the toner or toner scattering, which presents a risk to humans, may occur. When the volume average particle diameter of the toner is larger than 8 μm, it is difficult to obtain images having high resolution and high quality, charging may not be uniformly performed, fixing properties of the toner may be decreased, and a developer blade may not regulate the toner layer.

In exemplary embodiments, when an average circularity of toner is less than about 0.940, an image developed on a transfer medium is relatively high, which means that a toner consumption is increased, porosity between toner particles is overly increased, and thereby resulting in poor coating efficiency on the developed image. Accordingly, in order to obtain a required image concentration, a much larger amount of toner is required, which increases the toner consumption. On the other hand, when the average circularity of toner is larger than 0.990, the toner may be excessively fed to a sleeve for development, the sleeve may not be uniformly coated with the toner, thereby contaminating the sleeve.

The circularity of the toner as defined by the following expression may be determined with a flow-type particle image analyzer (FPIA)-3000 Model (manufactured by Sysmex Corporation):

$$\text{Circularity}=2\times(\pi\times\text{area})^{0.5}/\text{perimeter}$$

The circularity may be in the range of 0 to 1, with a value of 1 corresponding to a perfect circle.

Geometric standard deviation by volume (GSDv) and geometric standard deviation by number (GSDp) values of the toner may be used as indicators of the toner particle distribution, which are measured in the following manner. However, the present general inventive concept is not limited thereto. That is, alternative exemplary embodiments, the toner particle distribution may be measured by various other methods or techniques which provide the intended purposes of the general inventive concept as described herein.

First, the particle size distribution of toner, measured by using a Coulter counter (Multisizer 3, Beckman Coulter, Inc., USA), is divided into particle size ranges (channels), and a cumulative distribution curve in terms of volume and number of toner particles is subtracted from the side of smaller particles in the particle size distribution. On the cumulative distribution curve, particle sizes giving a particle accumulation of 16% are defined as a volume average particle size D16v and a number average particle size D16p, respectively, and particle sizes giving a particle accumulation of 50% are defined as a volume average particle size D50v and a number average particle size D50p, respectively.

GSDv and GSDp values may be obtained using the relationship between the GSDv, which is defined by (D84v/D16v)0.5, and the GSDp, which is defined by (D84p/D16p) 0.5.

The GSDv and GSDp values of the toner may be about 1.30 or less, respectively, for example, from about 1.15 to about 1.30, specifically from 1.20 to about 1.25. When the GSDv and GSDp values are larger than 1.30, the toner particle diameters may not be uniform.

In the method of preparing the toner according to an exemplary embodiment of the present general inventive concept, the first latex particles may be polyester used alone, a polymer obtained by polymerizing one or more polymerizable monomers, or a mixture thereof (a hybrid type). When the polymer is used as the first latex particles, the polymerizable monomers may be polymerized with a release agent such as a wax, or a wax may be separately added to the polymer.

The polymerizing may be performed by emulsion polymerization, in which latex particles having a particle size of 1 μm or less, for example, from about 100 nm to about 300 nm, or from about 150 nm to about 250 nm, may be prepared.

The polymerizable monomer may be at least one selected from the group consisting of styrene-based monomers, such as styrene, vinyl toluene, and a-methyl styrene; acrylic acid or methacrylic acid; derivatives of (metha)acrylates, such as methyl acrylate, ethyl acrylate, propyl acrylate, butyl acrylate, 2-ethylhexyl acrylate, dimethylamino ethyl acrylate, methyl methacrylate, ethyl methacrylate, propyl methacrylate, butyl methacrylate, 2-ethylhexyl methacrylate, dimethylaminoethyl methacrylate, acrylonitrile, methacrylonitrile, acrylamide, and metacryl amide; ethylenically unsaturated mono-olefins, such as ethylene, propylene, and butylenes; halogenized vinyls, such as vinyl chloride, vinylidene chloride, and vinyl fluoride; vinyl esters, such as vinyl acetate, and vinyl propionate; vinyl ethers, such as vinyl methyl ether, and vinyl ethyl ether; vinyl ketones, such as vinyl methyl ketone, and methyl isoprophenyl ketone; and nitrogen-containing vinyl compounds, such as 2-vinylpyridine, 4-vinylpyridine and N-vinyl pyrrolidone. However, the present general inventive concept is not limited thereto.

In the preparation of the first latex particles, a polymerization initiator and/or a chain transfer agent may be used for achieving efficient polymerization.

Exemplary embodiments of the polymerization initiator for radical polymerization include persulfate salts, such as potassium persulfate, and ammonium persulfate; azo compounds, such as 4,4-azobis(4-cyano valeric acid), dimethyl-2,2'-azobis(2-methyl propionate), 2,2-azobis(2-amidinopropane)dihydrochloride, 2,2-azobis-2-methyl-N-1,1-bis (hydroxymethyl)-2-hydroxyethylpropioamide, 2,2'-azobis (2,4-dimethyl valeronitrile), 2,2'-azobis isobutyronitrile, and 1,1'-azobis(1-cyclohexanecarbonitrile); and peroxides, such as methyl ethyl peroxide, di-t-butylperoxide, acetyl peroxide, dicumyl peroxide, lauroyl peroxide, benzoyl peroxide, t-butylperoxy-2-ethyl hexanoate, di-isopropyl peroxydicarbonate, and di- t-butylperoxy isophthalate. However, the present general inventive concept is not limited thereto. Also, an oxidization-reduction initiator in which the polymerization initiator and a reduction agent are combined may be used.

A chain transfer agent is a material that converts a type of chain carrier in a chain reaction. A new chain has much less activity than that of a previous chain. The polymerization degree of the monomer may be reduced and new chains may be initiated by using a chain transfer agent. In addition, a molecular weight distribution may be adjusted by using the chain transfer agent.

Exemplary embodiments of the chain transfer agent include S-containing compounds, such as dodecanthiol, thioglycolic acid, thioacetic acid, and mercaptoethanol; phosphorous acid compounds, such as phosphorous acid and sodium phosphite; hypophosphorous acid compounds, such as hypophosphorous acid and sodium hypophosphite; and alcohols, such as methyl alcohol, ethyl alcohol, isopropyl alcohol, and n-butyl alcohol. However, the present general inventive concept is not limited thereto.

In exemplary embodiments, an amount of the chain transfer agent may be in a range of about 0.1 to about 5 parts by weight, about 0.2 to about 3 parts by weight, and may also be about 0.5 to about 2.0 parts by weight based on 100 parts by weight of at least one polymerizable monomer. When the amount of the chain transfer agent is less than about 0.1 parts by weight based on 100 parts by weight of the at least one polymerizable monomer, the molecular weight is too large, which may decrease an agglomeration efficiency. On the other hand, when the amount of the chain transfer agent is larger than about 5 parts by weight based on 100 parts by weight of the at least one polymerizable monomer, the molecular weight is too small, which may deteriorate a fixing performance.

Exemplary embodiments of the chain transfer agent include S-containing compounds such as dodecanthiol, thioglycolic acid, thioacetic acid and mercaptoethanol; phosphorous acid compounds such as phosphorous acid and sodium phosphite; hypophosphorous acid compounds such as hypophosphorous acid and sodium hypophosphite; and alcohols such as methyl alcohol, ethyl alcohol, isopropyl alcohol and n-butyl alcohol. However, the present general inventive concept is not limited thereto.

In exemplary embodiments, the first latex particles may further include a charge control agent. The charge control agent used herein may be a negative charge type charge control agent or a positive charge type charge control agent. The negative charge type charge control agent may be an organic metal complex or a chelate compound such as an azo dye-containing chromium or a mono azo metal complex; a salicylic acid compound-containing metal such as chromium, Fe and zinc; or an organic metal complex of an aromatic hydroxycarboxylic acid and an aromatic dicarboxylic acid. Moreover, any other known charge control agents may also be used without limitation. The positive charge type charge control agent may be a modified product such as nigrosine and a fatty acid metal salt thereof and an onium salt including a quaternary ammonium salt such as tributylammonium 1-hydroxy-4- naphthosulfonate and tetrabutylammonium tetrafluoro borate which may be used alone or in combination of at least two. Since the charge control agent stably supports the toner on a developing roller by an electrostatic force, charging may be performed stably and quickly by using the charge control agent.

The prepared first latex may be mixed with a pigment dispersion. The pigment dispersion may be prepared by homogeneously dispersing a composition including pigments such as black, cyan, magenta and yellow and an emulsifier by using an ultrasonic processor, Micro fluidizer, or the like.

Carbon black or aniline black may be used as the pigment for a black toner, and for color toner, at least one of yellow, magenta and cyan pigments may be further included.

In exemplary embodiments, a condensation nitrogen compound, an isoindolinone compound, an anthraquine compound, an azo metal complex or an allyl imide compound may be used as the yellow pigment. In particular, C.I. pigment yellow 12, 13, 14, 17, 62, 74, 83, 93, 94, 95, 109, 110, 111, 128, 129, 147, 168, 180, or the like may be used.

In exemplary embodiments, a condensation nitrogen compound, an anthraquine compound, a quinacridone compound, a base dye lake compound, a naphthol compound, a benzo imidazole compound, a thioindigo compound or a perylene compound may be used as the magenta pigment. In particular, C.I. pigment red 2, 3, 5, 6, 7, 23, 48:2, 48:3, 48:4, 57:1, 81:1, 122, 144, 146, 166, 169, 177, 184, 185, 202, 206, 220, 221, 254, or the like may be used.

In exemplary embodiments, a copper phthalocyanine compound and derivatives thereof, an anthraquine compound, or a base dye lake compound may be used as the cyan pigment. In particular, C.I. pigment blue 1, 7, 15, 15:1, 15:2, 15:3, 15:4, 60, 62, 66, or the like may be used.

Such pigments may be used alone or in a combination of at least two pigments, and may be selected in consideration of color, chromacity, luminance, resistance to weather, dispersion capability in toner, etc.

In exemplary embodiments, an amount of the pigment as described above may be about 0.5 to about 15 parts by weight, about 1 to about 12 parts by weight, and may be about 2 to about 10 parts by weight based on 100 parts by weight of the polymerizable monomer. The amount of the pigment should be sufficient to color the toner; however, when the amount of the pigment is less than about 0.5 parts by weight based on 100 parts by weight of the polymerizable monomer, the coloring effect is not sufficient. Alternatively, when the amount of the pigment is larger than about 15 parts by weight based on 100 parts by weight of the polymerizable monomer, the manufacturing costs of the toner increase, and thus a sufficient frictional charge amount may not be obtained.

In alternative exemplary embodiments, any other emulsifier that is known in the art may also be used as the emulsifier used in the pigment dispersion. In this regard, an anionic reactive emulsifier, a nonionic reactive emulsifier or a mixture thereof may also be used. The anionic reactive emulsifier may be HS-10 (Dai-ichi Kogyo, Co., Ltd.), Dawfax 2-A1 (Rhodia Inc.), etc., and the nonionic reactive emulsifier may be RN-10 (Dai-ichi Kogyo, Co., Ltd.).

A releasing dispersion used in the preparation of the toner includes a release agent, water, and an emulsifier.

The release agent allows a toner to be fixed on a final image receptor at low temperature and to have excellent durability and excellent abrasion resistance. Thus, it is understood that a type and an amount of the release agent are important factors to provide desired properties of the toner.

Exemplary embodiments the release agents include, but are not limited to, polyethylene-based wax, polypropylene-based wax, silicone wax, paraffin-based wax, ester-based wax, Carnauba wax and metallocene wax. The melting point of the release agent may be about 50° C. to about 150° C. Components of the release agent may physically adhere to the toner particles, but may not covalently bond to the toner particles. A toner is provided which is fixed on a final image receptor at a low fixing temperature and illustrates good final image durability and abrasion resistance.

In exemplary embodiments, the release agent is included in an amount of about 1 to about 20 parts by weight, about 2 to about 16 parts by weight, specifically about 3 to about 12 parts by weight, based on 100 parts by weight of the toner. When the amount of the release agent is less than about 1 part by weight, fixing properties may be degraded and the fixing temperature range may be narrowed. On the other hand, when the amount of the release agent is more than about 20 parts by weight, storage stability of the toner may be degraded.

The release agent according to an exemplary embodiment of the present general inventive concept may be a wax containing an ester group, and examples of waxes include, but are not limited to, a mixture of an ester-based wax and a non-ester wax, or a wax obtained by adding an ester group to a non-ester wax.

Since an ester group has high an affinity with respect to the latex component of toner, wax may be uniformly present among toner particles and the function of the wax may be effectively exerted. Meanwhile, if only ester-based wax is used, excessive plasticizing reactions may occur. Thus, the inclusion of the non-ester based wax may result in prevention of such excessive plasticizing reactions due to a releasing reaction with the latex. Therefore, development characteristics of toner may be maintained at appropriate levels for a long period of time.

Exemplary embodiments of the ester-based wax include esters of C15-C30 fatty acids and 1 to 5-valence alcohols, such as behenic acid behenyl, staric acid stearyl, stearic acid ester of pentaeritritol, or montanic acid glyceride. Also, if an alcohol component that forms ester is a monovalent alcohol, a number of carbon atoms may be in a range of about 10 to about 30, and if the alcohol component that forms ester is a polymeric alcohol, a number of carbon atoms may be in a range of about 3 to about 10.

Specifically, examples of the non-ester wax may include a polyethylene-based wax, a paraffin wax, and so on.

Exemplary embodiments of the wax containing the ester group include a mixture of a paraffin-based wax and an ester-based wax, paraffin-based waxes containing ester groups, and so on. However, the present general inventive concept is not limited thereto. Specifically, examples of commercially available products include P-280, P-318, P-319, and so on, which are manufactured by Chukyo yushi Co., Ltd.

When the wax used as the release agent is a mixture of a paraffin-based wax and an ester-based wax, an amount of the polyethylene-based wax may be in ranges of about 5% to about 39% by weight, about 7% to about 36% by weight, and about 9% to about 33% by weight, based on the total weight of the release agent.

An amount of the ester group in the release agent may be in ranges of about 5% to about 39% by weight, about 7% to about 36% by weight, and 9% to about 33% by weight, based on a total weight of the release agent. When the amount of the ester group is less than 5%, the release agent exhibits poor compatibility to latex. When the amount of the ester group is larger than 39%, a plasticity of toner excessively increases, so that it is difficult to maintain a developing stability of the toner for an extended period of time.

In alternative exemplary embodiments, any other emulsifier that is known in the art may also be used as the emulsifier used in the pigment dispersion. In this regard, an anionic reactive emulsifier, a nonionic reactive emulsifier or a mixture thereof may be used. The anionic reactive emulsifier may be HS-10 (Dai-ichi Kogyo, Co., Ltd.), Dawfax 2-A1 (Rhodia Inc.), etc., and the nonionic reactive emulsifier may be RN-10 (Dai-ichi Kogyo, Co., Ltd.).

In exemplary embodiments, the molecular weight, a glass transition temperature (Tg), and rheological properties of the first latex particles may be adjusted to efficiently fix the toner particles at a low temperature.

In exemplary embodiments, the prepared first latex particles, the colorant dispersion and the release agent dispersion are mixed, and then an agglomerating agent is added to the mixture, to thereby prepare an agglomerated toner. More particularly, after the first latex particles are prepared, the colorant dispersion and the release agent dispersion are mixed, the agglomerating agent is added to the mixture at a pH of 1 to 4 to form a first agglomerated toner having an average particle size of 2.5 μm as a core. Then, a second latex is added to the resultant, and the pH is adjusted to 6 to 8. When the particle size is constantly maintained for a certain period of time, the resultant is heated to a temperature in a range of about 90° C. to about 98° C., and the pH is adjusted to 5 to 6 to in order to prepare a second agglomerated toner.

The agglomerating agent may be at least one selected among metal salts containing Si and Fe. Exemplary embodiments of the metal salts containing Si and Fe include polysilica iron.

In exemplary embodiments, the second latex may be obtained by polymerizing one or more polymerizable monomers on the first agglomerated toner. The polymerizable monomers may be emulsion polymerized to prepare latex having a particle size of less than 1 μm, preferably in a range of 100 nm to 300 nm. The second latex may also include a wax, and the wax may be added to the second latex during the polymerization process.

Meanwhile, a third latex prepared by polymerizing one or more polymerizable monomers may be coated on the second agglomerated toner.

By forming a shell layer with the second latex or the third latex, a durability of the tone may be improved, and storage problems of the toner during shipping and handling may also be overcome. In the present exemplar embodiment, a polymerization inhibitor may also be added in order to prevent new latex particles from being formed, or, alternatively, the reaction may be performed by using a starved-feeding method to facilitate coating of the monomer mixture on the toner.

In exemplary embodiments, the prepared second agglomerated toner or a third agglomerated toner may be filtered to separate toner particles and the toner particles may be dried. The dried toner particles are subject to a surface treatment process by using silica or the like, and a charge amount may be controlled to prepare a final dry toner.

In exemplary embodiments, the externally added additive may be silica or TiO2. An amount of the externally added additive may be in a range of about 1.5 to about 7 parts by weight, specifically about 2 to about 5 parts by weight, based on 100 parts by weight of an externally added additive-free toner. When the amount of the externally added additive is less than about 1.5 parts by weight, toner particles gather together due to a cohesive force, which may be referred to a caking phenomenon (i.e., toner particles which are attached to each other), and the charge amount is unstable. On the other hand, when the amount of the externally added additive is larger than about 7 parts by weight, an excessive amount of the externally added additive may contaminate a roller.

According to another exemplary embodiment of the present general inventive concept, an imaging forming method includes forming a visible image by attaching a toner to a surface of a photoreceptor having an electrostatic latent image formed thereon, and transferring the visible image to a transfer medium, wherein an [Fe] detected in the toner is in a range of about $1.0\times10^2$ to $1.0\times10^4$ ppm and a circle equivalent diameter of a sectional area of an Fe agglomerating agent is in a range of about 1.0 nm to about $2.0\times10^2$ nm, as analyzed by using a TEM.

Typically, an electrophotographic imaging process includes charging, exposing, developing, transferring, fixing, cleaning, and charge removing operations in order to form an image on a receiving structure.

In the charging operation, a photoreceptor may be coated with a negative charge or a positive charge by a corona or a charging roller. In the exposing operation, the charged surface of the photoreceptor may be selectively discharged to form a latent image in an image-wise manner in which an arrangement of an optical system, typically a laser scanner or an array of diodes, corresponds to a target image that is to be formed on a final image receptor. The electromagnetic irradiation referred to herein as "light" may be infrared irradiation, visible light irradiation, or ultraviolet irradiation.

In the developing operation, toner particles having sufficient polarity may contact the latent image on the photoreceptor, and an electrically-biased developer having a same potential polarity as the toner may be used. Toner particles move toward the photoreceptor and are selectively attached to the latent image by an electrostatic force so that a toner image is formed on the photoreceptor.

In the transferring operation, the toner image may be transferred from the photoreceptor to the final image receptor. In some cases, an intermediate transferring element may be used during the latter part of the transferring operation of the toner image from the photoreceptor to the final image receptor.

In the fixing operation, the toner image on the final image receptor may be heated so that the toner particles are softened or melted to be fixed on the final image receptor. Alternatively, the toner image may be fixed on the final image receptor by high pressure and heating or by high pressure alone.

In the cleaning operation, a residual toner on the photoreceptor may be removed.

In the charge removing operation, charges of the photoreceptor may be exposed to light having a specific wavelength band so that the charges may be uniformly reduced to a low value. Therefore, the residual of the latent image is removed and the photoreceptor is prepared for the subsequent imaging cycle.

A toner supplying unit according to an exemplary embodiment of the present general inventive concept includes a toner tank to store toner, a supplying part to project inside the toner tank to discharge the toner, and a toner agitating member rotatably disposed inside the toner tank to agitate the toner in an inner space of the toner tank including a location on a top surface of the supplying part, wherein the toner is used to develop an electrostatic latent image and includes latex, a colorant, and a releasing agent, wherein an [Fe] detected in the toner is in a range of about $1.0\times10^2$ to about $1.0\times10^4$ ppm and a circle equivalent diameter of a sectional area of an Fe agglomerating agent is in a range of about 1.0 nm to about $2.0\times10^2$ nm, as analyzed by using a TEM. However, the present general inventive concept is not limited thereto. That is, in alternative exemplary embodiments, a circle equivalent diameter of the Fe agglomerating agent may be analyzed and/or measured by various other methods or techniques which provide the intended purposes of the general inventive concept, as described herein.

FIG. 1 is a perspective view of a toner supplying apparatus 100 according to an exemplary embodiment of the present general inventive concept.

The toner supplying apparatus 100 includes a toner tank 101, a supplying part 103, a toner-conveying member 105, and a toner-agitating member 110.

The toner tank 101 stores a predetermined amount of toner and may be formed in a substantially hollow cylindrical shape. However, the present general inventive concept is not limited thereto. That is, the toner tank 101 may be formed in various shapes and sizes which provide for the intended purposes of the present general inventive concept, as described herein.

In exemplary embodiments, the supplying part 103 may be disposed at a bottom of an inside of the toner tank 101 and may discharge the stored toner from the inside of the toner tank 101 to an outside of the toner tank 101. In an exemplary embodiment, the supplying part 103 may project from the bottom of the toner tank 101 to the inside of the toner tank 101 in a pillar shape having a semi-circular section. The supplying part 103 includes a toner outlet (not illustrated) to discharge the toner to an outer surface of the toner tank 101.

In exemplary embodiments, the toner-conveying member 105 may be disposed at a side of the supplying part 103 at the bottom of the inside of the toner tank 101. The toner- conveying member 105 may be formed in, for example, a coil spring shape. An end of the toner-conveying member 105 extends in an inside the supplying part 103 so that when the toner-conveying member 105 rotates, the toner in the toner tank 101 is conveyed to the inside of the supplying part 103. The toner conveyed by the toner-conveying member 105 is discharged outside of the toner tank 101 through the toner outlet.

The toner-agitating member 110 is rotatably disposed inside the toner tank 101 and forces the toner in the toner tank 101 to move in a radial direction. In exemplary embodiments, when the toner-agitating member 110 rotates at a middle of the toner tank 101, the toner in the toner tank 101 is agitated to prevent the toner from solidifying. As a result, the toner moves down to the bottom of the toner tank 101 by a force, such as gravity. The toner-agitating member 110 includes a rotation shaft 112 and a toner agitating film 120. The rotation shaft 112 may be rotatably disposed at a central portion of the toner tank 101 and has a driving gear (not illustrated) coaxially coupled with an end of the rotation shaft 112 projecting from a side of the toner tank 101. Therefore, a rotation of the driving gear causes the rotation shaft 112 to rotate. Also, the rotation shaft 112 may have a wing plate 114 to help fix the toner agitating film 120 to the rotation shaft 112. The wing plate 114 may be formed to be substantially symmetric about the rotation shaft 112. The toner agitating film 120 has a width which corresponds to an inner length of the toner tank 101. Furthermore, the toner agitating film 120 may be elastically deformable. In an exemplary embodiment, the toner agitating film 120 may bend toward or away from a projection inside the toner tank 101, i.e., the supplying part 103.

In exemplary embodiments, portions of the toner agitating film 120 may be cut off from the toner agitating film 120 toward the rotation shaft 112 to form a first agitating part 121 and a second agitating part 122. However, the present general inventive concept is not limited thereto. That is, in alternative exemplary embodiments, the toner agitating film 120 may include additional agitating parts.

An imaging apparatus according to an exemplary embodiment of the present general inventive concept includes an image carrier, an image forming unit to form an electrostatic latent image on a surface of the image carrier, a unit to receive a toner, a toner supplying unit to supply the toner onto the surface of the image carrier to develop the electrostatic latent image into a toner image, and a toner transferring unit to transfer the toner image to a transfer medium from the surface of the image carrier, wherein the toner includes a latex, a colorant, and a releasing agent, wherein an [Fe] detected in the toner is in a range of about $1.0\times10^2$ to about $1.0\times10^4$ ppm and a circle equivalent diameter of a sectional area of an Fe agglomerating agent is in a range of about $1.0\times10^2$ nm to $2.0\times10^2$ nm, as analyzed by using a TEM.

Figure 2:
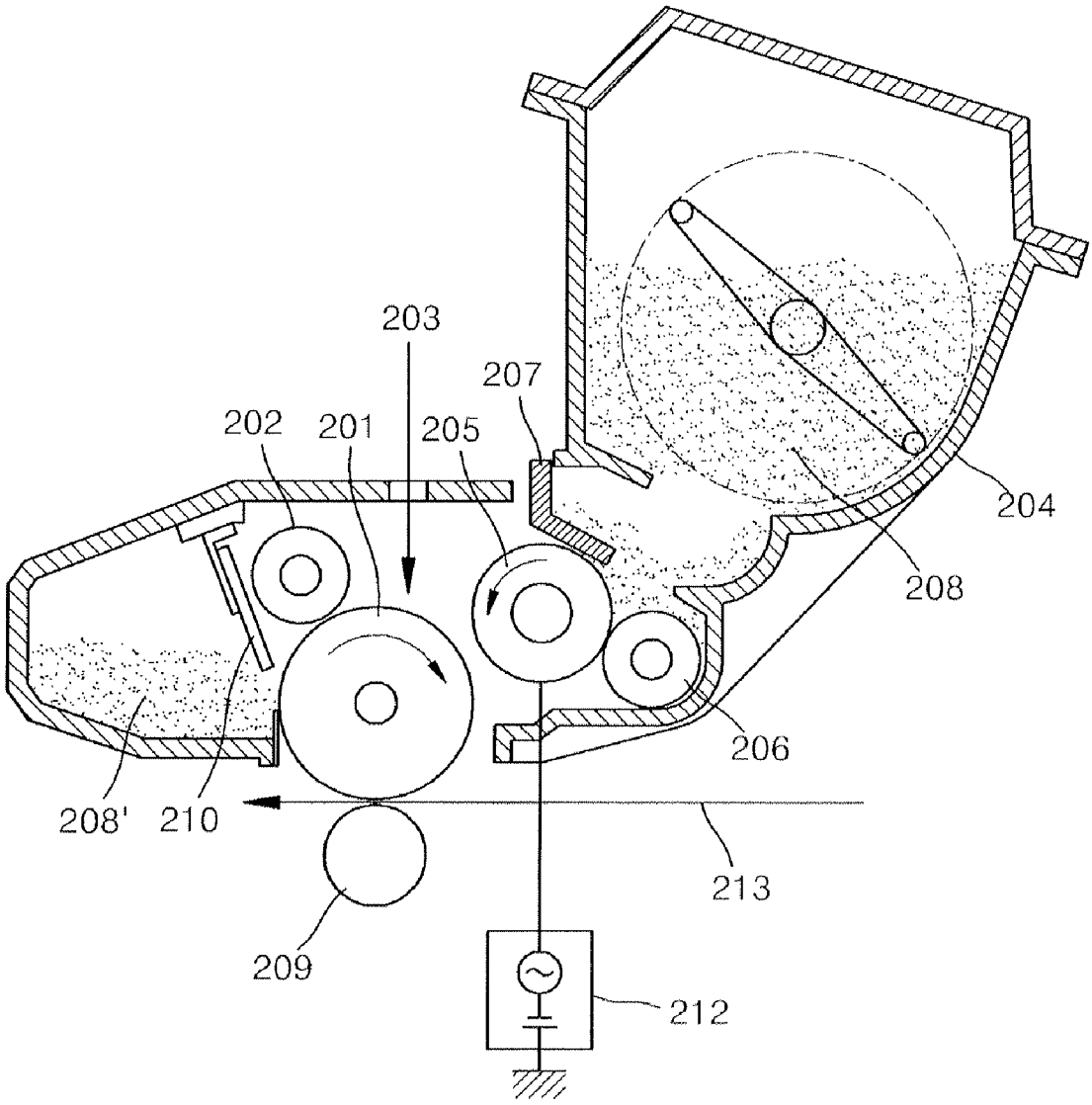
FIG. 2 is cross-sectional view of an image forming apparatus according to an exemplary embodiment of the present general inventive concept.

FIG. 2 is a cross-sectional view of a non-contact development type imaging apparatus including toner prepared using a method according to an exemplary embodiment of the present general inventive concept.

A developer (such as a toner) 208 which includes a non-magnetic one-component of a developing device 204 is supplied to a developing roller 205 by a supply roller 206 formed of an elastic material, such as polyurethane foam or sponge. The developer 208 supplied to the developing roller 205 reaches a contact portion between a developer controlling blade 207 and the developing roller 205 due to a rotation of the developing roller 205. The developer controlling blade 207 may be formed of an elastic material, such as metal or rubber. When the developer 208 passes through the contact portion between the developer controlling blade 207 and the developing roller 205, the developer 208 may be controlled and formed into a thin layer which has a uniform thickness and is sufficiently charged. The developer 208 which has been formed into a thin layer may be transferred to a development region of a photoreceptor 201 which is an image carrier, on which a latent image is developed by the developing roller 205. At this time, the latent image is formed by scanning light 203 onto the photoreceptor 201.

In exemplary embodiments, the developing roller 205 may be separated from the photoreceptor 201 by a predetermined distance and may face the photoreceptor 201. The developing roller 205 rotates in a counter-clockwise direction, and the photoreceptor 201 rotates in a clockwise direction.

The developer 208 which has been transferred to the development region of the photoreceptor 201 develops the latent image formed on the photoreceptor 201 by using an electric force generated by a potential difference between a direct current (DC) biased alternating current (AC) voltage applied to the developing roller 205 and a latent potential of the photoreceptor 201 charged by a charging unit 202 so as to form a toner image.

The developer 208, which has been transferred to the photoreceptor 201, reaches a transfer unit 209 due to the rotation direction of the photoreceptor 201. The developer 208, which has been transferred to the photoreceptor 201, may be transferred to a print medium 213 to form an image by the transfer unit 209 having a roller shape and to which a high voltage having a polarity opposite to the developer 208 may be applied or by a corona discharge when the print medium 213 passes between the photoreceptor 201 and the transfer unit 209. In exemplary embodiments, a voltage may be generated and/or controlled by a voltage controller 212.

The image transferred to the print medium 213 passes through a high temperature and high pressure fusing device (not illustrated) and thus the developer 208 is thereby fused to the print medium 213 to form the image. Meanwhile, a non-developed, residual developer 208'disposed on the developing roller 205 may be collected by the supply roller 206 which contacts the developing roller 205, and the non-developed, residual developer 208' on the photoreceptor 201 is collected by a cleaning blade 210. The processes described above are repeated as required.

The present general inventive concept will now be described in further detail with reference to the following examples, which are for illustrative purposes only and are not intended to limit the scope of the present inventive concept.

Shapes of the toners prepared according to Examples and Comparative examples that follow were identified with scanning electron microscope (SEM) images. A degree of circularity of toner as defined by the following expression may be determined with a FPIA-3000 Model, which is manufactured by Sysmex Corporation:

$$\text{Circularity}=2\times(\pi\times\text{area})^{0.5}/\text{perimeter}$$

The circularity may be in a range of 0 to 1, with a value of 1 corresponding to a perfect circle.

EXAMPLE 1

Synthesis of First Latex Particles

A dispersion of a wax and a polymer was prepared by using the following procedure.

A monomer mixture of 234 g of styrene, 96 g of n-butyl acrylate, 14 g of methacrylic acid and 6.5 g of polyethylene glycol-ethyl ether methacrylate, and 5 g of dodecanthiol as a chain transfer agent were mixed. 500 g of 2% aqueous solution of SDS (Aldrich) as an emulsifier was added to the monomer mixture to be emulsified at a temperature from 60° C. to 80° C. by using an ultrasonic homogenizer, yielding a polymerizable monomer emulsion. The prepared polymerizable monomer emulsion was added to a reactor that was heated to 80° C., 860 g of 3.2% potassium persulfate (KPS) aqueous solution as a polymerization initiator was added thereto, and then the resultant was reacted while an inside of the reactor was purged with nitrogen for 2 hours. When the reaction was terminated, a monomer mixture of 145 g of styrene, 66 g of n-butyl acrylate and 9 g of methacrylic acid, and 3.3 g of 1-dodecanethiol was added to the reactor by using a starved-feeding method for 60 minutes and the mixture was further reacted for 6 hours. Then, the resultant was cooled naturally to obtain first latex particles. The particle size of the resultant toner latex was measured by a light scattering apparatus (Horiba 910) to be 140 nm.

Preparation of Pigment Dispersions 10 g of a mixture of an anionic reactive emulsifier (HS-10; Dai-ichi Kogyo, Co., Ltd.) and a nonionic reactive emulsifier (RN-10; Dai-ichi Kogyo, Co., Ltd.) in weight ratios illustrated in Table 2 below, 60 g of a colorant (black, cyan, magenta, yellow) and 400 g of glass beads each having a diameter of 0.8 mm to 1 mm were added to a milling bath, and the mixture was milled at room temperature to prepare a dispersion by using a ultrasonic homogenizer (VCX-750, by Sonics & Materials, Inc.).

TABLE 2

| Color | Type of pigment | HS-10:RN-10 (wt %) | Particle diameter (Size) |
|---|---|---|---|
| Black | Mogul-L | 100:0 | 130 nm |
| | | 80:20 | 120 nm |
| | | 0:100 | 100 nm |

TABLE 2-continued

| Color | Type of pigment | HS-10:RN-10 (wt %) | Particle diameter (Size) |
|---|---|---|---|
| Yellow | PY-84 | 100:0 | 350 nm |
| | | 50:50 | 290 nm |
| | | 0:100 | 280 nm |
| Magenta | PR-122 | 100:0 | 320 nm |
| | | 50:50 | 300 nm |
| | | 0:100 | 290 nm |
| Cyan | PB 15:4 | 100:0 | 130 nm |
| | | 80:20 | 120 nm |
| | | 80:30 | 120 nm |

Agglomeration and Preparation of Toners 500 g of deionized water, 136 g of the first latex for a core prepared according to the process described above, 35 g of a 19.5% cyan colorant dispersion (100% HS-10), and 28 g of 35% P-419 (manufactured by Chukyo yushi Co., Ltd) (a mixture of about 20 to 30% of a paraffin-based wax and about 10 to 20% of an ester-based wax; a melting point: about 90.8° C.) were added to a 1-L reactor. 15 g nitric acid (0.3 mol) and 15 g of 16% PSI-025 (manufactured by Suido Kiko Co.) as an agglomerating agent were added to the resultant mixture in the reactor and stirred at 11,000 rpm for 6 minutes by using a homogenizer to obtain a first agglomerated toner having a diameter of 1.5 μm to 2.5 μm. The resultant was added to a 1-L double-jacketed reactor, and heated from room temperature to 50° C. (Tg of the latex-5° C.) at a rate of 0.5° C. per minute. When a volume average particle diameter of the first agglomerated toner reached 5.8 μm, 64 g of a second latex prepared by polymerizing polystyrene-based polymerizable monomers was added to the first agglomerated toner. When the volume average particle diameter reached 6.0 μm, NaOH (1 mol) was added thereto to adjust the pH to 6.8. When the volume average particle diameter was constantly maintained for 10 minutes, the temperature was increased to 96° C. at a rate of 0.5° C./min. When the temperature reached 96° C., nitric acid (0.3 mol) was added thereto to adjust the pH to 5.9. Then, the resultant was agglomerated for 3-5 hours to obtain a second agglomerated toner having a diameter of 5-6 μm having an elliptical shape. Then, a reactant of the second agglomerated toner was cooled to a temperature lower than Tg, filtered to be separated, and dried.

External additives were added to the toner by adding 0.5 parts by weight of NX-90 (Nippon Aerosil), 1.0 parts by weight of RX-200 (Nippon Aerosil), and 0.5 parts by weight of SW-100 (Titan Kogyo) to 100 parts by weight of the dried toner particles, and then, the mixture was stirred using a mixer (KM-LS2K, Daehwa Tech.) at a rate of 8,000 rpm for 4 minutes. The resultant toner had a volume average particle diameter of 5.9 μm. GSDp and GSDv of the final toner were 1.24 and 1.25, respectively. The average circularity of the final toner was 0.98.

EXAMPLE 2

Toner was prepared in the same manner as in Example 1, except that when a volume average particle diameter of the first agglomerated toner reached 6.0 μm, the pH was adjusted to 7.0. GSDp and GSDv of the toner were respectively 1.23 and 1.22. An average circularity of the toner was 0.98.

EXAMPLE 3

Toner was prepared in the same manner as in Example 1, except that when the temperature was increased to 96° C., the pH was adjusted to 5.5 by adding nitric acid (0.3 mol). GSDp and GSDv of the toner were respectively 1.22 and 1.23. An average circularity of the toner was 0.97.

COMPARATIVE EXAMPLE 1

Toner was prepared in the same manner as in Example 1, except that instead of PSI-B, PSA was used as an agglomerating agent.

GSDp and GSDv of the toner were respectively 1.30 and 1.31. An average circularity of the toner was 0.98.

COMPARATIVE EXAMPLE 2

Toner was prepared in the same manner as in Example 1, except that 60 g of 16% PSI-025 (manufactured by Suido Kiko Co.) was used as an agglomerating agent. GSDp and GSDv of the toner were respectively 1.24 and 1.25. An average circularity of the toner was 0.92.

COMPARATIVE EXAMPLE 3

Toner was prepared in the same manner as in Example 1, except that 15 g of 16% PSI-025, (manufactured by Suido Kiko Co.), was used as an agglomerating agent and stirred using a homogenizer at 11,000 rpm for 2 minutes. GSDp and GSDv of the toner were respectively 1.28 and 1.29. An average circularity of the toner was 0.93.

Evaluation of Properties of Toners

Analysis of Metal Ion in Toners

Device: Inductively Coupled Plasma-Analytical Emission Spectrometer (ICP-AES) (ICPS-8100, manufactured by Shimadzu Corporation)

Sample: 100 mg (Externally added toner or external additive-free toner)

Component Analysis: Samples were heated to about 800° C. to remove organic matter, added to a solution containing 2.0 ml of distilled water, 0.02 ml of concentrated nitric acid, and 0.02 ml of concentrated fluoric acid to dissolve residual materials, and diluted with distilled water, followed by an analysis using an ICPS-8100, manufactured by Shimadzu, to measure Fe contents.

Analysis of Sections of Toners

Device: TEM, such as Tecnai F20st manufactured by Titan Kogyo, Japan, and Ultramicrotome, such as Power TOME XL manufactured by RMC, USA.

Pre-conditioning samples: Toner particles were stained with $RuO_4$ (vapor) and molded using epoxy resin. The toner particles were cut by using an ultramicrotome, such as Power TOME XL manufactured by RMC, and sections were observed by using a TEM.

Component Analysis: Components and contents of a sample were analyzed by using the TEM and an energy dispersive X-ray spectroscopy (EDX).

Evaluation of Fixing (Hot-Offset) Properties

Device: Belt-type fixing device, such as a Color Laser 660 model manufactured by Samsung Co., Ltd., Korea.

Unfixed image to be tested: 100% pattern

Test temperature: 130° C. to 250° C. (at 5° C. intervals)

Fixing rate: 160 mm/sec

Fixing time: 0.08 to 0.16 sec

After performing experiments under the above-described conditions, fixing properties of the fixed images were evaluated in the following manner.

After measuring the optical density (OD) of a fixed image, an image area was coated with an adhesive tape, e.g., 3M 810 tape, and was subjected to a reciprocating motion 5 times by using a 500 g weight. Next, the tape was peeled off to measure the OD of the image.

Fixing strength(%)=(OD_After peeling/OD_Before peeling)×100

An area where the fixing strength is over 90% is considered as a fixing area of the toner.

Minimum Fusing Temperature (MFT) means a minimum temperature at which the fixing strength of the fixed image is over 90% without an occurrence of a cold-offset phenomenon. Hot-Offset Temperature (HOT) means a minimum temperature at which a hot-offset phenomenon occurs to the fixed image.

Evaluation of Gloss

Glossiness values were measured by using a glossmeter, such as micro-TRI-gloss manufactured by BYK Gardner, and a highest glossiness value was selected.

Angle for measurement: 60°

Pattern for measurement: 100% pattern

Evaluation of High-Temperature Storage Stability

External additives were added to 100 g of a toner and then put into an oven with a constant temperature and humidity, as follows, in a packaged state:

23° C., 55% RH (Relative Humidity) 2 hour storage

=>40° C., 90% RH 48 hour storage

=>50° C., 80% RH 48 hour storage

=>40° C., 90% RH 48 hour storage

=>23° C., 55% RH 6 hour storage

After the toner was stored under the conditions described above, 100% of an image was printed out. Then, the image was visually observed in terms of whether or not caking occurred to thereby determine defective images.

Evaluation Criteria are defined as follows:

◎: Image quality was "excellent" and no caking occurred;

○: Image quality was "good" and no caking occurred;

Δ: Image quality was "poor" and no caking occurred; and

X: Image "defects" were observed and caking occurred.

Evaluation of Charge Properties 28.5 g of a carrier and 1.5 g of a toner were added into a 60 ml glass vessel and stirred by a tubular mixer. An amount of toner charged was measured by using electric field separation.

The charging performance of toners was evaluated by charging stability, depending on a stirring time under a normal temperature/normal humidity environment and a ratio of a charge amount of the toner in a high-temperature/high-humidity (HH) condition to a charge amount of the toner in a low-temperature/low-humidity (LL) condition.

Evaluation Criteria are defined as follows:

HH: 32° C., 80% RH

LL: 10° C., 10% RH

Evaluation of Streaks

A 500-sheet durability test was performed under the 20 page per minute (PPM) and 0% operating condition by using a color laser printer, such as a fixing device as Color Laser 660 Model sold by Samsung Co., Ltd., Korea. To determine an occurrence or nonoccurrence of streaks, a final image was evaluated based on whether the transfer medium (ex. printing paper) was contaminated or not. The state of contamination and any influence on the image due to the contamination were visually observed and evaluated according to the following criteria:

◎: Contamination is observed a little, and no image defects occurred at all;

○: Contamination is somewhat observed, but does not affect images;

Δ: Contamination is observed, but is not seen to have affected the images; and

X: Severe contamination is observed, and adversely affects images.

The results of evaluation on the toners according to Examples 1 through 3 and Comparative Examples 1 through 3 are illustrated in Table 3.

TABLE 3

| | Fe Content [ICP] [ppm] | Sectional Analysis [TEM] Diameter of Fe [nm] | Charging Stability HH/LL | Durability: Streaks | Durability: High-Temp. Storage Stability | Fixing Property: HOT [° C.] | Fixing Property: Gloss |
|---|---|---|---|---|---|---|---|
| Example 1 | $3.0 \times 10^3$ | $3.0 \times 10^1$ | 0.89 | ○ | ○ | 240 | 4.6 |
| Example 2 | $5.0 \times 10^3$ | $7.0 \times 10^1$ | 0.85 | ○ | ○ | 230 | 3.9 |
| Example 3 | $8.53 \times 10^3$ | $1.0 \times 10^2$ | 0.90 | ○ | ○ | 240 | 5.2 |
| Comp. Example 1 | None | None | 0.70 | ○ | ○ | 200 | 2.1 |
| Comp. Example 2 | $1.2 \times 10^4$ | $6.0 \times 10^1$ | 0.57 | ○ | ○ | 230 | 4.2 |
| Comp. Example 3 | $7.0 \times 10^3$ | $2.5 \times 10^2$ | 0.67 | x | x | 180 | 1.8 |

Referring to Table 3, the measurement results illustrate that Fe contents as agglomerating agents added to the toners were generally at least $1.0\times10^2$ ppm. When the [Fe] was larger than $1.0\times10^4$ ppm, excess metal ions may adversely affect toner characteristics as impurities, thereby deteriorating charging properties of the toner.

When a circle equivalent diameter of a sectional area of each of the Fe agglomerating agents is larger than $2\times10^2$ nm, as analyzed by using the TEM, it was confirmed that the charging properties, a durability, and fixing performance of the toner were deteriorated. This is presumably because the Fe agglomerating agents were not uniformly distributed but were agglomerated, so that the release agent, pigments, resin or the like may not be uniformly dispersed in the toner, causing agglomeration, and thereby deteriorating the toner properties.

While the present general inventive concept has been particularly shown and described with reference to exemplary embodiments thereof, it will be understood by those of ordinary skill in the art that various changes in form and details may be made therein without departing from the spirit and scope of the present general inventive concept as defined by the following claims and their equivalents.

Although a few exemplary embodiments of the present general inventive concept have been shown and described, it will be appreciated by those skilled in the art that changes may be made in these exemplary embodiments without departing from the principles and spirit of the general inventive concept, the scope of which is defined in the appended claims and their equivalents.

What is claimed is:

1. A toner usable with electrophotography, comprising:

a latex;

a colorant; and a release agent, wherein an iron (Fe) content in the toner is in a range of about $1.0\times10^2$ ppm to about $1.0\times10^4$ ppm and a circle equivalent diameter of a sectional area of an Fe agglomerating agent is in a range of about 1.0 nm to about $2.0\times10^2$ nm.

2. The toner of claim 1, wherein the toner comprises a core layer including a first latex, a colorant, and a release agent, and a shell layer including a second latex coated on the core layer.

3. The toner of claim 1, wherein when the toner comprises sulfur (S), Fe, and silicon (Si), and contents thereof are indicated by [S], [Fe] and [Si], the toner has a [S]/[Fe] ratio in a range of about $5.0\times10^{-4}$ to about $5.0\times10^{-2}$, and a [Si]/[Fe] ratio in a range of about $5.0\times10^{-4}$ to about $5.0\times10^{-2}$.

4. The toner of claim 1, wherein the release agent is a mixture of paraffin-based wax and ester-based wax, or paraffin-based wax containing an ester group.

5. The toner of claim 4, wherein if the releasing agent comprises a mixture comprising the paraffin-based wax and the ester-based wax, an amount of the ester-based wax is in a range of about 5% to 39% by weight based on a total amount of the release agent.

6. The toner of claim 1, wherein a volume average particle diameter of the toner is in a range of about 3 μm to about 8 μm.

7. The toner of claim 1, wherein an average circularity of the toner is in a range of about 0.940 to about 0.990.

8. The toner of claim 1, wherein geometric standard deviation by volume (GSDv) and a geometric standard deviation by number (GSDp) values of the toner areabout 1.30 or less.

9. A method of preparing a toner usable with electrophotography, the method comprising:

preparing a mixture solution by mixing first latex particles with a colorant dispersion and a release agent dispersion;

preparing a first agglomerated toner by adding an agglomerating agent to the first latex particles; and preparing a second agglomerated toner by coating second latex particles on the first agglomerated toner prepared by polymerizing at least one polymerizable monomer, wherein an iron (Fe) content in the toner is in a range of about $1.0\times10^2$ ppm to about $1.0\times10^4$ ppm and a circle equivalent diameter of a sectional area of an Fe agglomerating agent is in a range of about 1.02 nm to about $2.0\times10^2$ nm.

10. The method of claim 9, wherein the first latex particles are polyester used alone, a polymer obtained by polymerizing one or more polymerizable monomers, or a mixture thereof.

11. The method of claim 9, further comprising:

coating a third latex prepared by polymerizing one or more polymerizable monomers to the second agglomerated toner.

12. The method of claim 9, wherein the polymerizable monomer is at least one selected from the group consisting of styrene-based monomers; acrylic acid or methacrylic acid; derivatives of (metha)acrylates; ethylenically unsaturated mono-olefins; halogenized vinyls; vinyl esters; vinyl ethers; vinyl ketones; and nitrogen-containing vinyl compounds.

13. The method of claim 9, wherein the release agent dispersion includes a mixture of a paraffin-based wax and an ester-based wax; or a paraffin-based wax containing ester groups.

14. The method of claim 9, wherein the agglomerating agent comprises a metal salt containing Si and Fe.

15. The process of claim 9, wherein the agglomerating agent comprises polysilicate iron.

* * * * *